US006730868B1

(12) United States Patent
Watanabe

(10) Patent No.: US 6,730,868 B1
(45) **Date of Patent: *May 4, 2004**

(54) KEYSWITCH DEVICE AND KEYBOARD DEVICE

(75) Inventor: Makoto Watanabe, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/395,510

(22) Filed: Mar. 24, 2003

(51) Int. Cl.[7] ..... H01H 13/70
(52) U.S. Cl. ..... 200/344
(58) Field of Search ..... 200/5 A, 517, 200/344, 345; 400/490–496

(56) References Cited

U.S. PATENT DOCUMENTS 5,329,084 A * 7/1994 Watanabe et al. ..... 200/344
5,823,325 A * 10/1998 Lin ..... 200/344
6,020,566 A * 2/2000 Tsai ..... 200/344
6,100,482 A * 8/2000 Koma et al. ..... 200/344
6,399,909 B1 * 6/2002 Okada ..... 200/344
6,509,536 B2 * 1/2003 Sasaki ..... 200/344

FOREIGN PATENT DOCUMENTS

JP 11-16440 1/1999 ..... H01H/13/14

* cited by examiner

*Primary Examiner*—Michael A. Friedhofer
(74) *Attorney, Agent, or Firm*—Brinks Hofer Gilson & Lione

(57) ABSTRACT

A keyswitch device of the invention includes a plurality levers (first to third levers), one side of each lever rotating engaging the base plate; a holder supported so as to be upwardly and downwardly movable with respect to the base by being engaged with the other side of each lever; and a switch, disposed between the base plate and the holder, for performing a switching operation as the keytop is moved upward and downward. Rotary shafts of the first and second levers symmetrically disposed on the left and right sides engage a groove of the holder. A rotary shaft of the third lever is disposed so as to cross the rotary shafts disposed at engagers at the first and second levers.

9 Claims, 6 Drawing Sheets

KEYSWITCH DEVICE AND KEYBOARD DEVICE

BACKGROUND OF THE INVENTION

1. Field of the Invention

The present invention relates to a keyswitch device suitable for use in a keyboard device used as an input/output device of, for example, a word processor or a personal computer, and a keyboard device including the keyswitch device.

2. Description of the Related Art

Hereunder, a related X-shaped keyswitch device used in a keyboard device will be described with reference to FIGS. 4 and 5. A mount member 31 is formed of, for example, a metallic plate and comprises a bottom wall 31*a,* a plurality of relatively long supporting sections 31*b,* and a plurality of semi-circular arc shaped holding sections 31*c*. In order to form the supporting sections 31*b,* cuts are formed in the bottom wall 31*a* and the cut portions that are joined at two sides are raised. These cut-and-raised portions are disposed side by side and correspond to the supporting sections 31*b*. In order to form the holding sections 31*c,* cuts are formed in the bottom wall 31*a* in a cantilever manner and the cut portions that are joined at one side are raised. These cut-and-raised portions are disposed side by side and correspond to the holding sections 31*c,* each of which forms a pair with its associated supporting section 31*b*. A flexible substrate (not shown) having a plurality of stationary contacts is disposed on the top surface of the bottom wall 31*a*. A movable contact member 33 comprises a cup-shaped movable section 33*a,* formed of resin or the like, and a contact section 33*b,* disposed on the upper surface of the inner portion of the movable section 33*a*. The movable contact member 33, opposing stationary contacts 32, is mounted to the flexible substrate. When the movable section 33*a* is pushed and moved, the contact section 33*b* comes into contact with the stationary contacts 32, whereas, when the movable section 33*a* is released, the movable section 33*a* returns to its original state by itself, causing the contact section 33*b* to move out of contact with the stationary contacts 32. A first lever 34 is molded out of synthetic resin and has a U shape. It comprises a pair of arms 34*a,* a connecting section 34*b* connected to one end of each arm 34*a,* and a circular cylindrical engager 34*c* disposed at the other end of each arm 34*a*. A second lever 35 is molded out of synthetic resin and has an H shape. It comprises a pair of arms 35*a,* a connecting section 35*b* connected to the central portion of each arm 35*a,* and circular cylindrical engagers 35*c* and 35*d* disposed at respective ends of each arm 35*a*. By positioning the second lever 35 inside the first lever 34 and placing them so that their central portions are aligned, the first and second levers 34 and 35 are rotatably combined in the form of a cross by a rotary shaft 34*d,* so that the combined form of the first and second levers 34 and 35 has an X-shaped pantograph structure. With the rotary shaft 34*d* as a fulcrum, the upper sides of the first and second levers 34 and 35 can move vertically. The first and second levers 34 and 35 combined in this manner are mounted to the mount member 31 in the following way. First, as shown in FIG. 4, one end of one arm 35*a* and one end of the other arm 35*a* of the second lever 35 are pushed towards each other in the directions of arrows X. With these ends of the arms 35*a* moved towards each other, the engagers 35*c* are aligned with their respective holding sections 31*c*. When, after the alignment, the ends of the arms 35*a* that have been pushed towards each other in the directions of arrows X are released, the arms 35*a* return to their original states by themselves, causing the engagers 35*c* to be engaged inside the respective holding sections 31*c*. Next, as shown in FIG. 4, one end of one arm 34*a* and one end of the other arm 34*a* of the first lever 34 are pushed towards each other in the directions of arrows Y. With these ends of the arms 34*a* moved towards each other, the engagers 34*c* are aligned with the respective supporting sections 31*b*. When, after the alignment, the ends of the arms 34*a* that have been pushed towards each other in the directions of arrows Y are released, the arms 34*a* return to their original states by themselves, causing the engagers 34*c* to be engaged inside the respective supporting sections 31*b*. In this way, both the first and second levers 34 and 35 are mounted to the mount member 31 with the pairs of arms 34*a* and 35*a* in pushed states. When the first and second levers 34 and 35 are mounted to the mount member 31, the movable contact member 33 is positioned below the central portions of the crossing portions of the first and second levers 34 and 35, so that the movable contact member 33 can be pushed by the second lever 35. A keytop 36 is molded out of synthetic resin and has the shape of an inverted boat. It comprises guides 36*a* and 36*b*. The guide 36*a* is a vertical groove disposed at the inner portion of the lower surface of the keytop 36. The guide 36*b* is a horizontal groove disposed at the inner portion of the lower surface of the keytop 36. The keytop 36 is mounted to and supported by the first and second levers 34 and 35 by fitting the connecting section 34*b* of the first lever 34 to the guide 36*a* and fitting the engagers 35*d* of the second lever 35 to the guide 36*b*. The one keytop 36 having such a structure, the pair of first and second levers 34 and 35, the movable contact member 33, the stationary contacts 32, and the mount member 31 form one keyswitch device. By disposing a plurality of such keyswitch devices, a keyboard device is formed. Next, the operation of such a related keyswitch device will be given. First, when the top surface of the keytop 26 is pressed, the first and second levers 34 and 35 are pushed, so that, with the rotary shaft 34*d* as a fulcrum, the first and second levers 34 and 35 are rotated and moved downward. At this time, the engagers 35*c* of the second lever 35 are rotated while they are held by their respective holding sections 31*c,* and the engagers 34*c* of the first lever 34 are slid horizontally while they are supported by their respective supporting sections 31*b*. At the keytop 36, the engagers 35*d* of the second lever 35 are slid horizontally inside the guide 36*b,* and the connecting section 34*b* of the first lever 34 is slid vertically inside the guide 36*a*.

By the downward movement of the first and second levers 34 and 35, the movable section 33*a* of the movable contact member 33 is pushed downward, causing the contact section 33*b* to come into contact with the stationary contacts 32, so that the keyswitch device is turned on. Next, when the keytop 36 is released, the movable section 33*a* returns to its original state, causing the first and second levers 34 and 35 to be pushed back upward. This causes the keytop 36 to move upward, so that the first and second levers 34 and 35 and the keytop 36 return to their original states before being pushed, so that the keyswitch device is turned off.

The keyswitch device having the above-described structure is widely used in, for example, keyboard devices of personal computers. However, size reduction of electronic devices in recent years has resulted in an increased tendency for a demand for smaller and thinner keyswitch devices. However, in the keyswitch device having the structure shown in FIGS. 4 and 5, the rotary shaft 34*d* serving as the center of rotation of the levers 34 and 35 is at the centers in the lengthwise direction of the levers 34 and 35, the keytop 36 is connected to the top sides of the levers 34 and 35 with the rotary shaft 34*d* as the center, and the bottom sides of the levers 34 and 35 are connected to the mount member 31, so that, as the levers 34 and 35 are shortened for the purpose of forming a smaller and thinner keyswitch device, a limit in the lengths of the levers 34 and 35 that allow smooth rotation is reached, so that further reduction in size and thickness cannot be achieved. In addition, in the keyswitch device having their levers disposed in the form of an X shape as viewed from a side, when a top peripheral edge of the top surface at a bearing side of the keytop 36 is pressed, the keytop 36 may tilt in directions A and B in FIG. 5, in which case it is pressed without being moved horizontally downward. In such a case, the contact section 33*b* may not come into contact with the stationary contacts 32 even if the keytop is pressed. Therefore, there is a demand for a keyswitch device which makes it possible to perform a key input operation by reliably causing the contact section to come into contact with the stationary contacts even when a peripheral edge of the top surface of the keytop is pressed by, for example, a finger.

SUMMARY OF THE INVENTION

The present invention has been achieved to overcome the aforementioned problems, and has as its object the provision of a keyswitch device which makes it possible to perform a key input operation by reliably causing a contact section to come into contact with a stationary contact even when a peripheral edge of the top surface of a keytop is pressed by, for example, a finger. It is another object of the present invention to provide a keyboard device which comprises the keyswitch device, which can be easily reduced in size, and which can be easily operated.

To these ends, according to one aspect of the present invention, there is provided a keyswitch device comprising a base; a plurality of levers, one side of each lever movably engaging the base; a keytop supported so as to be movable vertically with respect to the base by being engaged with the other side of each lever; and a switch for performing a switching operation when the keytop is moved vertically. In the keyswitch device, rotary shafts for allowing rotation of the respective levers within respective rotational planes are disposed at respective engagers at both sides of the levers. One of the engagers at each lever is a first engager for movably supporting one of the rotary shafts at the base or the keytop. The other engager at each lever is a second engager for rotatably supporting the other rotary shaft. The plurality of levers comprise a first lever, a second lever, and a third lever. The rotary shafts or rotary shaft lines of the first and second levers cross the rotary shafts of the third lever. The engagers at the keytop side at the first and second levers are the first engagers for movably engaging the rotary shafts of the first and second levers in a guide groove in the keytop.

In other words, unlike the related keyswitch device in which two levers are such that a shaft is fixed at the location where they cross, the levers independently engage the base and the keytop, and the rotary shafts of at least one lever are disposed so as to cross the rotary shafts of another lever. By virtue of such a structure, even if the lengths of the levers are reduced for reducing the size and thickness of the keyswitch device, the operability of the keyswitch device at the time of a key input operation is not impaired, and the keyswitch device can be more easily reduced in size and thickness than the related keyswitch device having an X-shaped supporting structure.

When a peripheral edge of the top surface of the keytop is pressed at the time of a key input operation, the keytop is not moved downward in a tilted state, but is moved downward in a substantially horizontal state. For example, if the case of supporting the keytop by two levers is considered, when, as in the related keyswitch device, the rotary shafts at the keytop side of these levers are disposed parallel to each other, the keytop can tilt in a direction perpendicular to these rotary shafts. However, in the structure of the present invention, tilting of the rotary shafts of one of the levers in the direction of rotation of the rotary shafts is restricted by the other lever whose rotary shafts cross these rotary shafts, so that the keytop is moved vertically in a horizontal state. Therefore, according to the keyswitch device of the present invention, rattling of the keytop in the horizontal direction can be prevented from occurring, and the keytop is moved vertically without being tiled, so that the switch can reliably perform a switching operation at the time of a key input operation.

Another structure may be used for the keyswitch device. Here, the keyswitch device comprises a base; a plurality of levers, one side of each lever movably engaging the base; a keytop supported so as to be movable vertically with respect to the base by being engaged with the other side of each lever; and a switch for performing a switching operation as the keytop is moved vertically. In the keyswitch device, rotary shafts for allowing rotation of the respective levers within respective rotational planes are disposed at respective engagers at both sides of the levers. One of the engagers at each lever is a first engager for movably supporting one of the rotary shafts at the base or the keytop. The other engager at each lever is a second engager for rotatably supporting the other rotary shaft. The plurality of levers comprise a first lever, a second lever, and a third lever. The rotary shafts or rotary shaft lines of the first and second levers cross the rotary shafts of the third lever. The engagers at the keytop side at the first and second levers are the second engagers for rotatably engaging the rotary shafts of the first and second levers in a guide groove in the keytop. Even with this structure, advantages similar to those of the keyswitch device of the one aspect are provided.

In a first form, the plurality of lever members each comprise a pair of arms and at least one connecting section connecting the arms, and each have a U shape or a frame shape in plan view, and the rotary shafts are disposed at respective sides of the arms. According to this structure, the switch can be surrounded by the levers without reducing the supporting strength of the key top by the levers.

In a second form, when the structure of the one aspect is used, the rotary shaft at the keytop side of the third lever is disposed below the rotary shafts at the keytop side of the first and second levers. According to this structure, by disposing the third lever whose rotary shafts cross the rotary shafts of the first and second levers below the first and second levers, space below the keytop can be effectively used, so that the keyswitch device can be easily reduced in thickness and size.

In a third form, when the structure of the first form is used, the first and second levers are each sandwiched at a pair of hook-shaped rotary bearings disposed at the base engaging the first and second levers, and the positions of the first and second levers in the lengthwise directions of the rotary shafts of the first and second levers are restricted by the respective pairs of hook-shaped rotary bearings. According to this structure, movements of the first and second levers in the directions of the rotary shafts are restricted, so that rattling of the keytop can be effectively restricted.

In a fourth form, when the structure of the first form is used, the third lever is sandwiched at and engaged with a pair of hook-shaped slide bearings disposed at the base, and the position of the third lever in the lengthwise direction of the rotary shaft is restricted by the hook-shaped slide bearings. According to this structure, movement of even the third lever in the directions of the rotary shafts can be restricted, so that rattling of the keytop can be further restricted.

In a fifth form, when the structure of the first form is used, the keytop and the third lever are engaged by engagement of a rotary bearing of the keytop and the shaft of the third lever, and the position of the rotary bearing is restricted by being sandwiched by the pair of arms of the third lever. According to this structure, the positions of the keytop and the third lever are restricted, so that rattling of the keytop can be more effectively restricted.

In a sixth form, when the structure of the one aspect is used, the keytop comprises a holder engaging each lever and a key cap adhered to the holder. By virtue of such a structure, since the structural members, including the holder, the levers, and the base, can be used as common members regardless of the type of key cap, a keyswitch device which has a wide range of application and which can allow easy replacement of, for example, the key cap can be provided.

In a seventh form, when the structure of the sixth form is used, the shafts at the keytop side of the first and second levers are sandwiched by a recessed portion of the holding member, where the guide groove for movably supporting the shafts is disposed, and the key cap adhered to the holder. By virtue of such a structure, the first and second levers can be easily engaged with the keytop, so that the keyswitch device can be easily assembled. Since the rotary shafts of the first and second levers are sandwiched by the key cap and the holder, the rotary shafts and the key cap are always kept parallel, so that tilting of the key cap occurs even less frequently.

According to another aspect of the present invention, there is provided a keyboard device comprising any one of the above-described keyswitch devices. The keyboard device comprising the keyswitch device of the present invention can be easily reduced in size and thickness and is such that the keytop of the keyswitch device can be moved vertically in a constantly horizontal state. Therefore, when the keyswitch device is pressed, a key input operation can be reliably performed, so that a keyboard having excellent operability can be provided.

DESCRIPTION OF THE PREFERRED EMBODIMENTS

Figure 1:
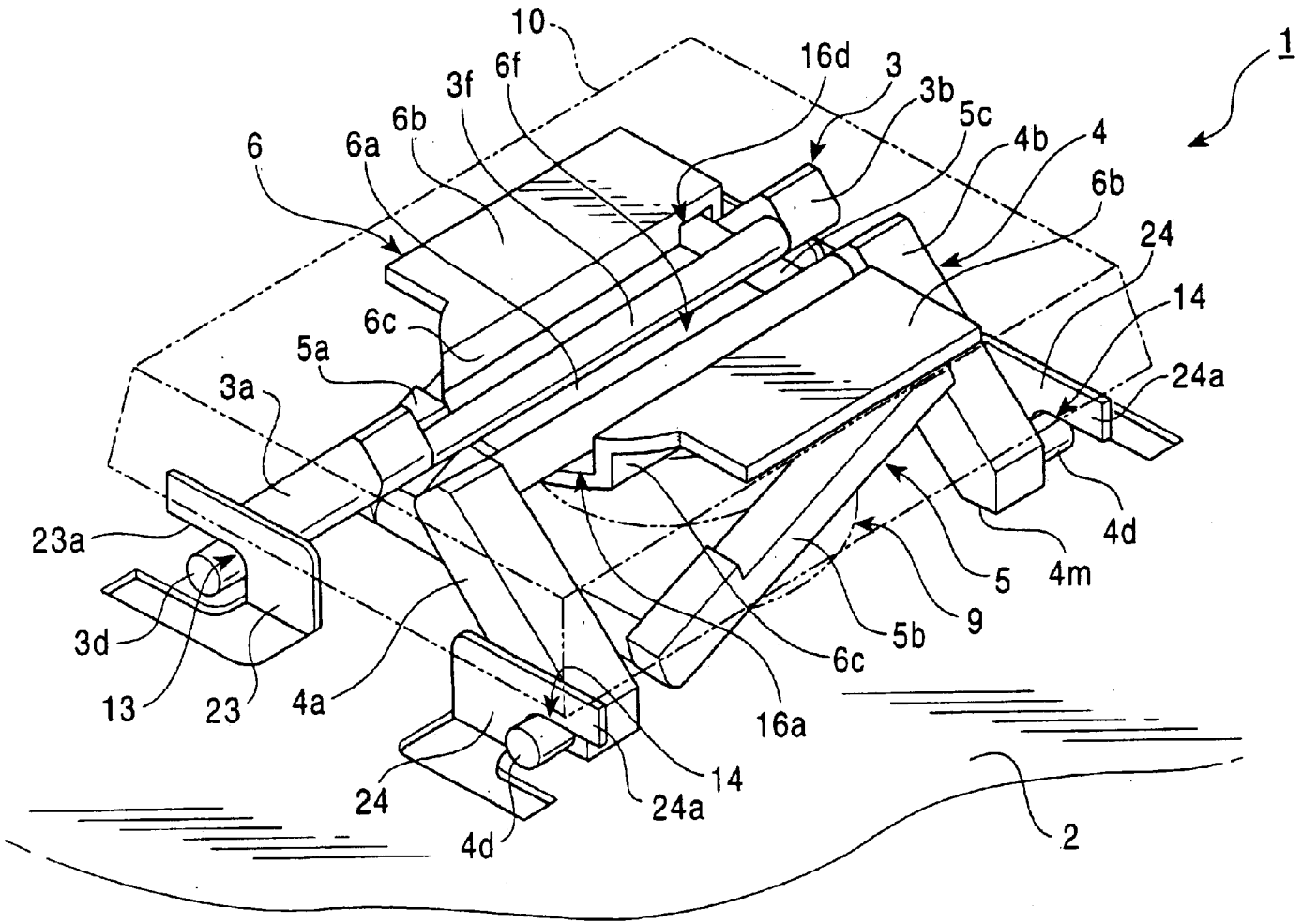
FIG. 1 is a structural perspective view of a keyswitch device of an embodiment of the present invention.
Figure 2:
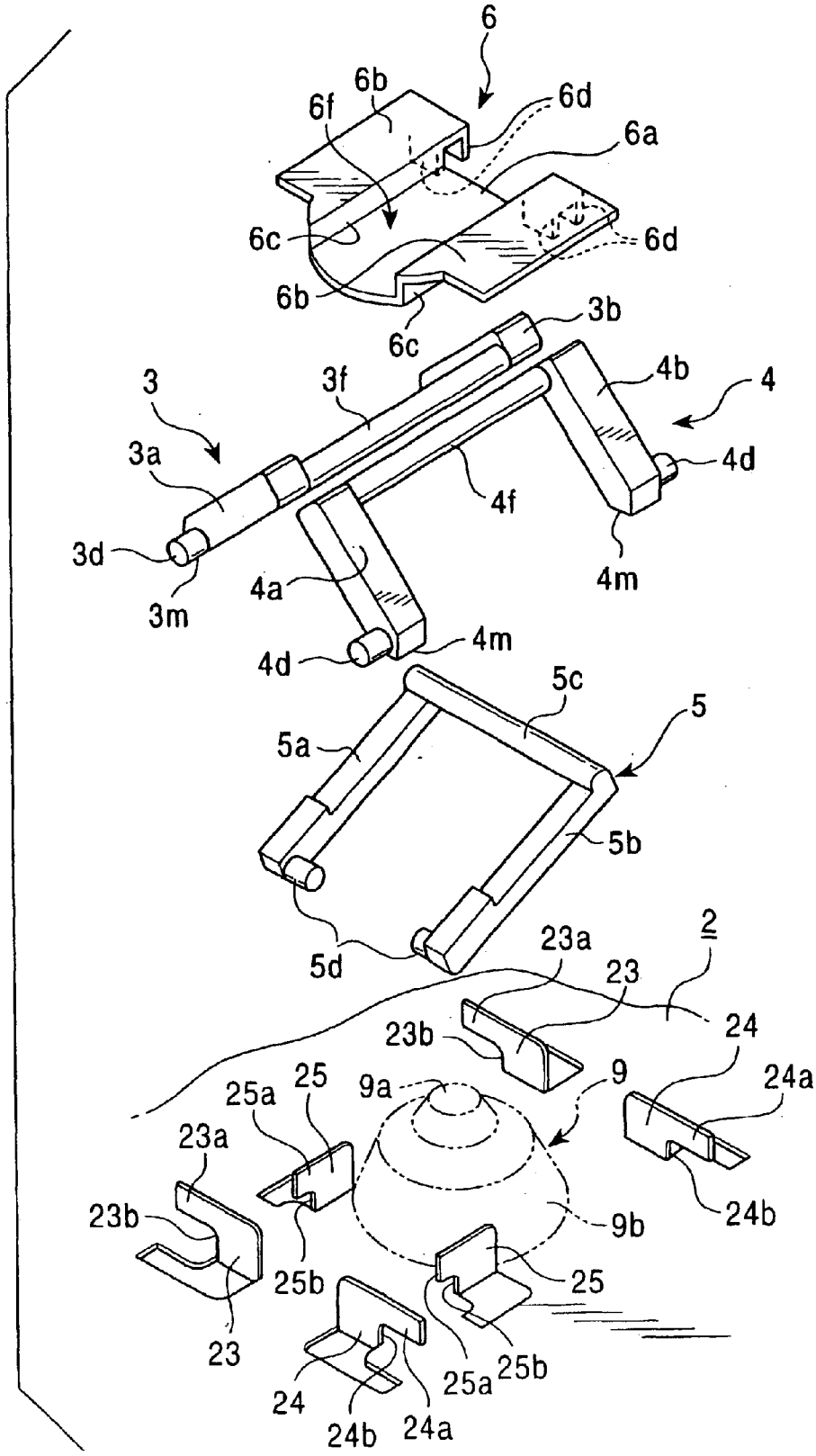
FIG. 2 is an exploded perspective view of the keyswitch device shown in FIG. 1.
Figure 3A:
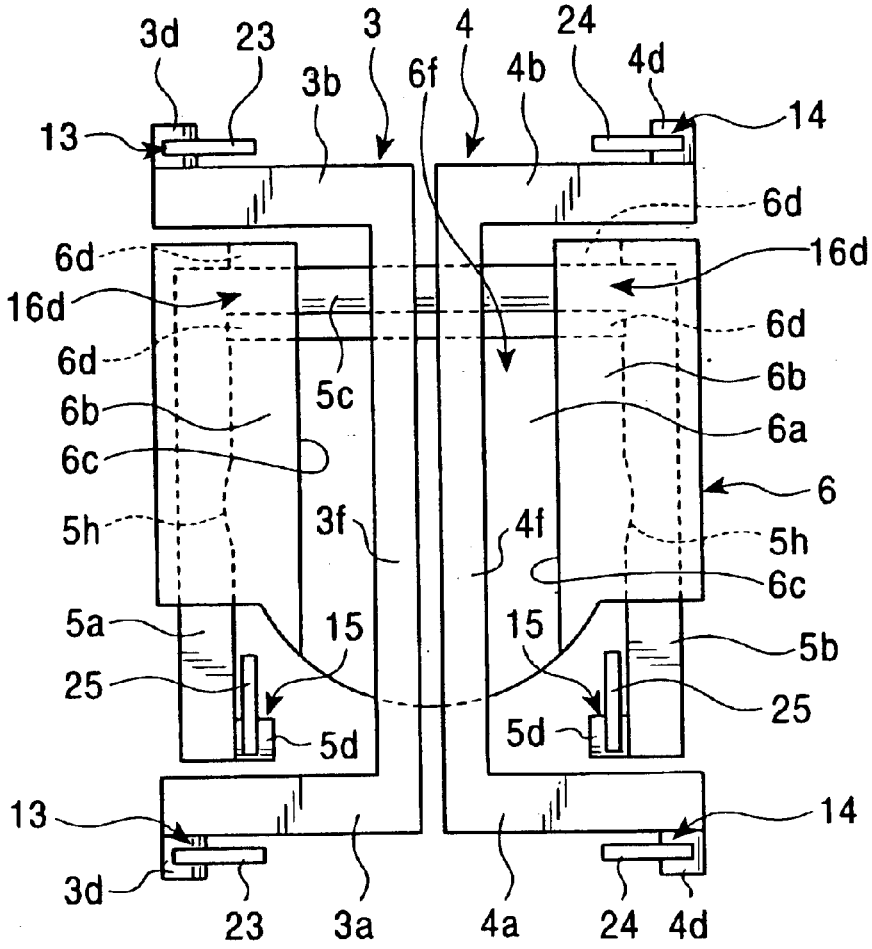
FIG. 3A is a top perspective view of the keyswitch device shown in FIG. 1.
Figure 3B:
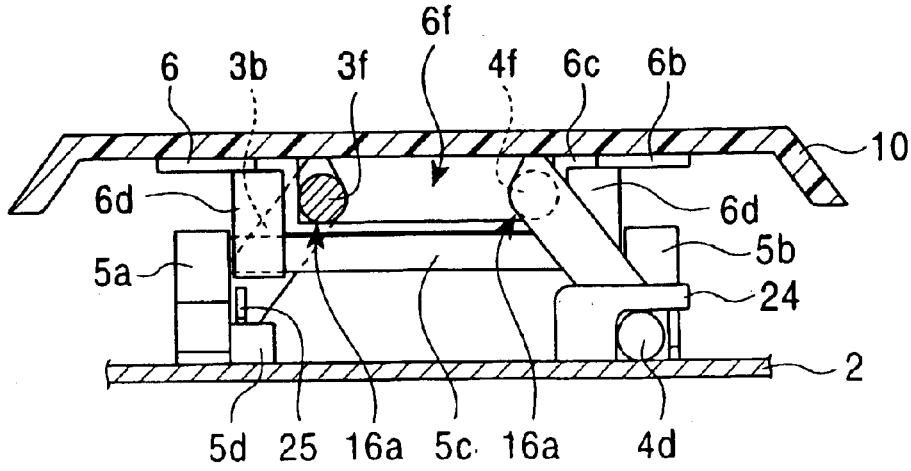
FIG. 3B is a partial sectional side view of the structure of the keyswitch device shown in FIG. 1.
Figure 4:
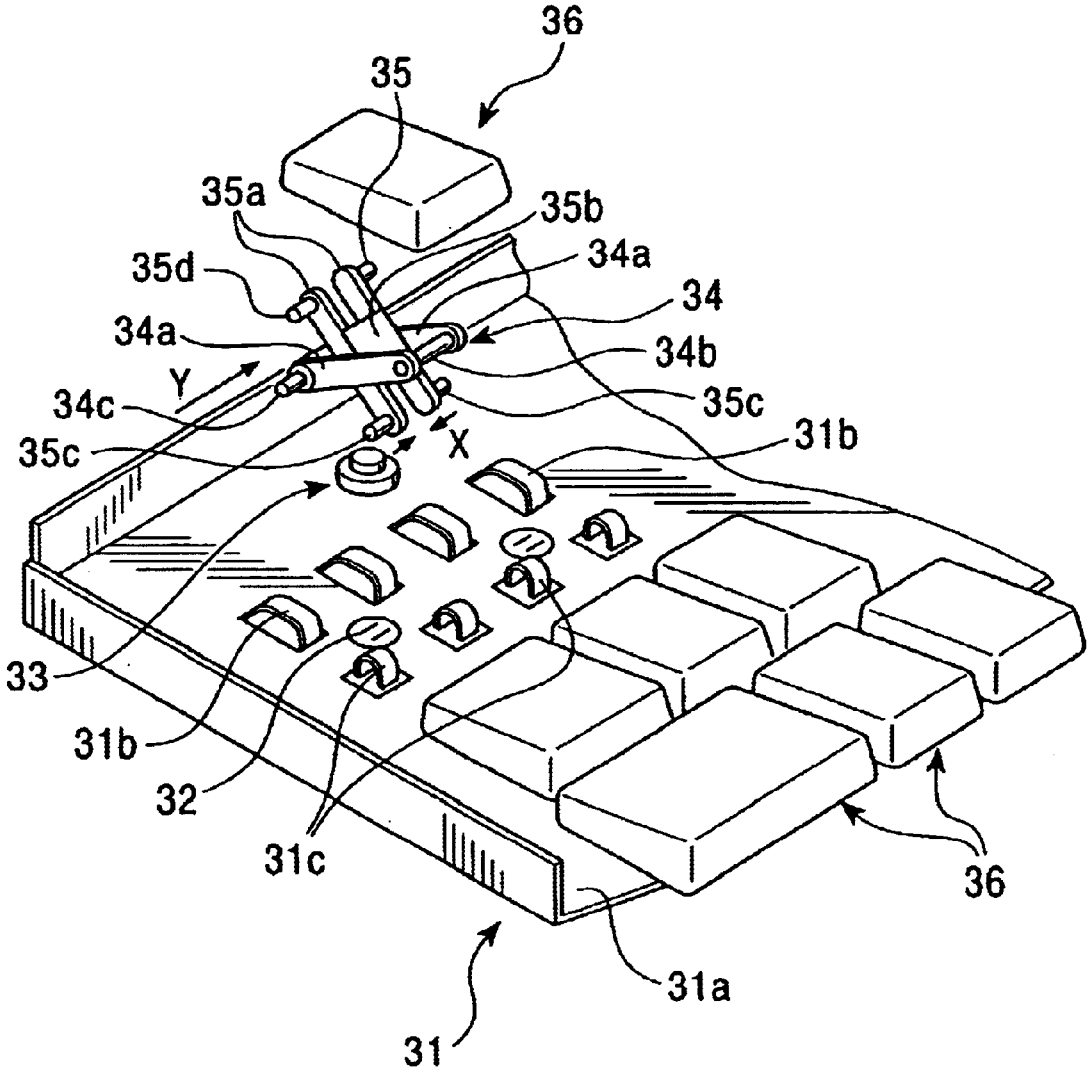
FIG. 4 PRIOR ART
FIG. 4 is an exploded perspective view of a keyboard device comprising a related keyswitch device.
Figure 5:
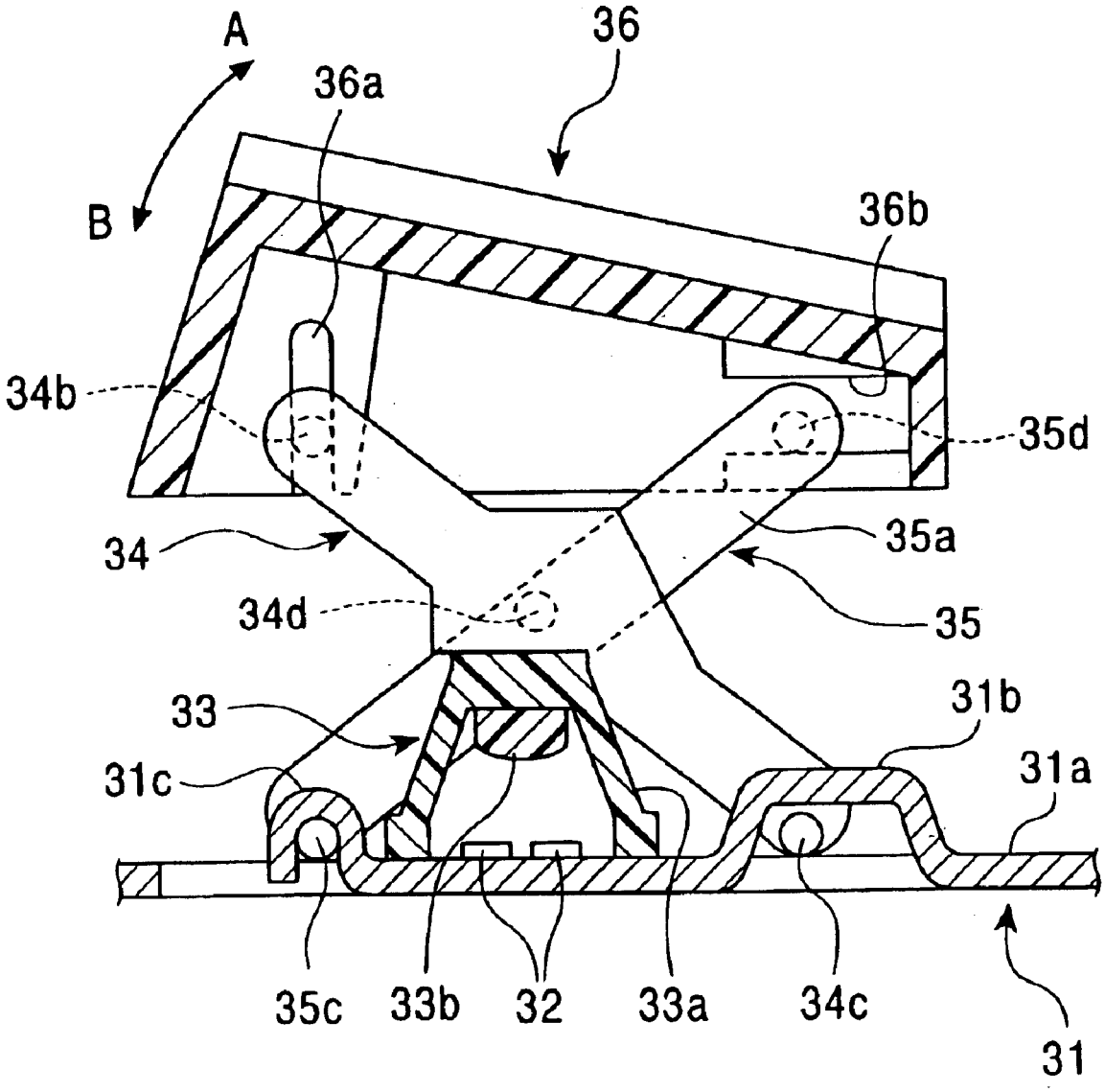
FIG. 5 PRIOR ART
FIG. 5 is a sectional view of the keyswitch device shown in FIG. 4.

Hereunder, a description of preferred embodiments of the present invention will be given with reference to the drawings. The present invention is not limited to the embodiments described below. FIG. 1 is a structural perspective view of a keyswitch device of an embodiment of the present invention. FIG. 2 is an exploded perspective view of the keyswitch device shown in FIG. 1. FIG. 3A is a top perspective view of the keyswitch device shown in FIG. 1. FIG. 3B is a partial sectional side view of the structure of the keyswitch device shown in FIG. 1.

A keyswitch device 1 shown in these figures comprises a base plate (base) 2, a first lever 3, a second lever 4, a third lever 5, a holder 6, and a key cap 10. One side of each of the first lever 3, the second lever 4, and the third lever 5 engages the base plate 2. The holder 6 engages the sides opposite to the sides at the base plate 2 side of the levers 3 to 5. The key cap 10 is adhered to holder 6. In the embodiment, the holder 6 and the key cap 10 form a keytop of the keyswitch device 1.

The base plate 2 is a substantially flat member formed of a metallic material. The base plate 2 has a pair of rotary bearings 23, a pair of rotary bearings 24, and a pair of slide bearings 25 in order to rotatably engage the levers 3, 4, and 5. They are formed by forming cuts in portions of the base plate 2 in a cantilever manner and raising the cut portions that are joined at one side. These pairs of cut-and-raised portions are formed parallel to each other. By this, the pairs of cut-and-raised portions having the shape of hooks as viewed from a side are formed. These cut-and-raised portions correspond to the rotary bearings 23, the rotary bearings 24, and the slide bearings 25. Hook-shaped ends 23*a* of the rotary bearings 23 and hook-shaped ends 24*a* of the rotary bearings 24 face away from each other. The cut-and-raised portion of one of the slide bearings 25 is disposed between the rotary bearings 23, and the cut-and-raised portion of the other slide bearing 25 is disposed between the rotary bearings 24. The cut-and-raised portions of the rotary bearings 23 and those of the rotary bearings 24 are perpendicular to the cut-and-raised portions of the slide bearings 25 in plan view. Bearing portions 23*b* and 23*b* of the rotary bearings 23 and 23 are coaxially formed, bearing portions 24*b* and 24*b* of the rotary bearings 24 and 24 are coaxially formed. Bearing portions 25*b* and 25*b* of the slide bearings 25 and 25 are also coaxially formed. The base plate 2 can be freely changed in size within a range which allows the levers 3 to 5 to be engaged and supported. In addition, the base plate 2 may formed of other materials, such as resinous material.

The levers 3 to 5 are each formed of, for example, a resinous or a metallic material. The levers 3 to 5 support the holder 6 and the key cap 10 so that the holder 6 and the key cap 10 can move vertically, and operate so that the vertical-movement width is confined with a predetermined range. The first lever 3 has a U shape in plan view. In the first lever 3, a pair of arms 3*a* and 3*b* and a shaft (connecting section) 3*f* connecting the inner surfaces of the ends of the arms 3*a* and 3*b* are integrally formed. At the outer surfaces of ends (opposite to the shaft 3*f*) of the arms 3*a* and 3*b*, shafts 3*d* and 3*d* that engage the respective rotary bearings 23 of the base plate 2 are coaxially formed so as to protrude outward from the lever 3. These shafts 3*d* and 3*d* engage the bearing portions 23*b* of the respective rotary bearings 23, so that the first lever 3 is rotatable with respect to the base plate 2 around the shafts 3*d* and 3*d*. In other words, by the rotary bearings 23 of the base plate 2 and the respective shafts 3*d* and 3*e* of the first lever 3, respective rotary engagers (second engagers) 13 and 13 are formed. Tapering portions 3*m* are formed at the bottom surfaces (at base plate 2 sides) of end portions of the respective arms 3*a* and 3*b* of the first lever 3, and have the same angles of inclination with respect to their respective arms 3*a* and 3*b*. These tapering portions 3*m* determine the angle of the first lever 3 with respect to the base plate 2. When the first lever 3 is maximally raised, these tapering portions 3*m* are in contact with the top surface of the base plate 2, and operate to restrict the angle at which the first lever 3 is raised (or the raise angle thereof). The shaft 3*f* having a circular cylindrical shape is formed at the holder 6 side of the first lever 3. By engaging the shaft 3*f* with the holder 6 (described later), the first lever 3 is rotatable and slidable with respect to a groove 6*f* (described later) of the holder 6. The holder 6 side of the first lever 3 is a slide engager (first engager) 16*a*.

The second lever 4 is formed with the same shape as the first lever 3, and comprises arms 4*a* and 4*b* and a shaft (connecting portion) 4*f* connecting the inner surfaces of ends of the arms 4*a* and 4*b*. Shafts 4*d* and 4*d* are coaxially provided at the outer surfaces of ends (opposite to the shaft 4*f*) of the respective arms 4*a* and 4*b* so as to protrude therefrom. These shafts 4*d* and 4*d* engage the bearing portions 24*b* of the respective rotary bearings 24, so that the second lever 4 can rotate with respect to the base plate 2 around the shafts 4*d* and 4*d*. The shafts 4*d* and 4*d* can rotate in their respective rotary bearings 24. The shaft 4*f* having a circular cylindrical shape rotatably and slidably engages the groove 6*f* of the holder 6. Accordingly, by the shafts 4*d* and 4*d* of the second lever 4 and the rotary bearings 24 and 24 of the base plate 2, rotary engagers (second engagers) 14 and 14 are formed. By the shaft 4*f* of the second lever 4 and the groove 6*f* of the holder 6, a slide engager (first engager) is formed. As shown in FIG. 3B, tapering portions 4*m* are formed at the bottom surfaces of ends of the arms 4*a* and 4*b*, so that the raise angle of the second lever 4 can be defined.

The third lever 5 has a U shape in plan view, and comprises arms 5*a* and 5*b*, which tilt with respect to the base plate 2 like the arms of the first and second levers 3 and 4, and a shaft 5*c*, disposed between respective ends of the arms 5*a* and 5*b*. Circular cylindrical shafts 5*d* and 5*d* are formed at the inner surfaces of ends of the arms 5*a* and 5*b* so as to protrude therefrom. The shafts 5*d* and 5*d* rotatably and slidably engage the respective slide bearings 25 at the base plate 2. The shaft 5*c* is rotatably supported by the holder 6. Therefore, as shown in FIG. 3A, in the third lever 5, the shafts 5*d* and 5*d* engaging the base plate 2 engage the slide bearings 25 and 25, so that slide engagers (first engagers) 15 and 15 are formed. Along with the holder 6, the shaft 5*c* forms a rotary engager (second engagers) 16*d*. As shown in FIG. 3A, in order to prevent interference with a switch 9 disposed at the inner sides of the arms 5*a* and 5*b*, recesses 5*h* and 5*h* having shapes corresponding to the inverted dish shape (outer shape) of the switch 9 are formed in the inner surfaces of the arms 5*a* and 5*b* of the third lever 5, respectively.

When the levers 3 to 5 are incorporated in the keyswitch device 1, the levers 3 and 4 are disposed symmetrically on the left and right sides as shown in FIG. 3B, and the lever 5 is disposed is disposed below the levers 3 and 4. The shafts 3*f* and 4*f* of the respective first and second levers 3 and 4 are disposed perpendicular to the shaft 5*c* of the third lever 5 in plan view. Since the levers 3 and 4 are sandwiched at the rotary bearings 23 and the rotary bearings 24 that engage the lever members 3 and 4, movements of the levers 3 and 4 in the directions of the rotary shafts are restricted. By sandwiching the arms 5*a* and 5*b* of the third lever 5 at the slide bearings 25, movement of the third lever 5 in the lengthwise directions of the shafts 5*d* are restricted by the slide bearings 25, so that rattling of the levers 3 to 5 on the base plate 2 is restricted.

The holder 6 has the shape of a recess as viewed from a side. The holder 6 comprises a substantially flat lower base 6*a*, side walls 6*c* and 6*c* disposed in an upstanding manner at respective sides of the lower base 6*a*, and upper bases 6*b* and 6*b*. The upper bases 6*b* and 6*b* are formed continuously with the side walls 6*c* and 6*c*. The groove (guide groove) 6*f* is formed in the central portion of the holder 6. Sides extending along the groove 6*f* of the upper bases 6*b* and 6*b* protrude outwardly of the lower base 6*a*. Two parallel bearings 6*d* and 6*d* are formed at the lower sides of the respective protruding portions of the upper bases 6*b* and 6*b* so as to protrude towards the base plate 2. As shown in FIG. 1, the shafts 3*f* and 4*f* of the respective first and second levers 3 and 4 rotatably and slidably engage the groove (guide groove) 6*f* formed in the central portion of the holder 6, so that slide engagers (first engagers) 16*a* are formed. The shaft 5*c* of the third lever 5 is inserted into the bearings 6*d* and 6*d*, so that rotary engagers (second engagers) 16*d* are formed. The shafts 3*f* and 4*f* of the respective first and second levers 3 and 4 are perpendicular to the shaft 5*c* of the third lever 5 in plan view, and the shaft 5*c* is disposed below the shafts 3*f* and 4*f*. By disposing the shaft 5*c* below the shafts 3*f* and 4*f*, space below the key cap 10 can be effectively used, so that the keyswitch device 1 can be easily reduced in size.

The switch 9 comprises a movable section 9*b* and a contact section 9*a*. The movable section 9*b* is formed of, for example, an elastic resinous material, such as rubber, and has the shape of an inverted cup. The contact section 9*a* is disposed on the top portion of the inner surface of the movable section 9*b*. With the wide side of the switch 9 facing the base plate 2, the switch 9 is disposed on the base plate 2 so as to be surrounded by the base 6*a* of the holder 6 and the levers 3 to 5. The contact section 9*a* is disposed opposing a stationary contact (not shown) disposed on the base plate 2. The switch 9 biases the holder 6 upward when it is not used. The switch 9 may be replaced by a sheet switch (which has upper sheets having movable contacts formed thereon and lower sheets having stationary contacts formed thereon stacked upon each other so that the contacts oppose each other) disposed on the upper side or the lower side of the base plate 2.

The key cap 10 is, for example, molded so that its outer shape is substantially trapezoidal. It has the shape of an inverted boat with an open bottom. A character (not shown), such as a number or an alphabetic letter, is printed on the top surface of the key cap 10. The key cap 10 is connected to the holder 6, so that a keytop of the keyswitch device 1 is formed. The shafts 3*f* and 4*f* of the respective levers 3 and 4 are engaged in the space formed by the key cap 10 and the groove 6*f* of the holder 6. This prevents the key cap 10 and the holder 6 from tilting in the direction of rotation of the shaft 5*c* of the third lever 5. The lower base 6*a* of the holder 6 is sandwiched at the arms 3*a* and 3*b* of the first lever 3 and the arms 4*a* and 4*b* of the second lever 4, so that movement of the holder 6 in the lengthwise directions of the shafts 3*f* and 4*f* is restricted.

In the keyswitch device 1 of the embodiment comprising the aforementioned structural members, in the non-operation state, as shown in FIG. 1, the holder 6 and the key cap 10 are biased upward by the elastic force of the switch 9. When the top surface of the key cap 10 is pressed by a key input operation, the holder 6 connected to the key cap 10 is moved downward in response to the movement of the key cap 10. Then, the switch 9 that is pushed by the bottom surface of the holder 6 is deformed, causing the contact section at the inner portion of the switch 9 to come into contact with a stationary contact on the base plate 2, so that the switch is turned on. When a finger is moved away from the key cap 10, the switch 9 elastically returns to its original state, and biases the holder 6 and the key cap 10 upward again.

The vertical movements of the key cap 10 cause the levers 3 to 5 to operate in the following manner. As the engagers of the symmetrically disposed first lever 3 and the second lever 4 and the holder 6 move downward, the arms 3*a* and 3*b* and the arms 4*a* and 4*b* are tilted with respect to the shafts 3*d* and the shafts 4*d* that engage the rotary bearings 23 and the rotary bearings 24. The shafts 3*f* and 4*f* engaging the groove 6*f* of the holder 6 are guided by the groove 6*f* and move horizontally towards each other. The arms 5*a* and 5*b* of the third lever 5 are tilted with respect to the shaft 5*c* engaging the bearings 6*d* of the holder 6, so, that the shafts 5*d* and 5*d* move horizontally while sliding inside the slide bearings 25 of the base plate 2.

In this way, since, unlike the related keyswitch device having an X-shaped supporting structure, the keyswitch device 1 of the embodiment does not have a rotary shaft at the central portions of the levers, even if the levers 3 to 5 are shortened to reduce the size and thickness of the keyswitch device, the levers 3 to 5 can be made shorter and smaller than the levers used in the related example, while allowing the structural parts of the keyswitch device to move smoothly vertically. Therefore, if the keyswitch device 1 of the embodiment is included as input means, a keyboard device or an electronic device can be easily reduced in size and thickness without impairing the operability of the keyswitch device 1 at the time of a key input operation.

In the keyswitch device 1 of the embodiment, the key cap 10 can be moved vertically while being held in a horizontal state, so that it is possible to prevent improper pressing of a key. Therefore, key input operation can be reliably performed. This is because, by providing the levers 3 to 5, the keyswitch device 1 has a structure in which the key cap 10 (and, thus, the holder 6) does not tilt when a peripheral edge of the key cap 10 is pressed. In other words, if the case where the third lever 5 is not provided is considered, the holder 6 may tilt in the direction around the shafts 3*f* and 4*f* (at the holder 6 side) of the respective first and second levers 3 and 4 that are symmetrically disposed on the left and right sides. However, in the embodiment, by providing the lever 5, the tilting of the holder 6 in the direction around the shafts 3*f* and 4*f* is restricted by the shafts 5*d* disposed in the direction in which they intersect the shafts 3*f* and 4*f*.

The keyswitch device 1 of the embodiment can have excellent operability during a key input operation almost without any rattling of the keytop in the horizontal direction. This is because a structure which restricts rattling in the horizontal direction at the engagers of the levers 3 to 5 and the holder 6 and the engagers of the levers 3 to 5 and the base plate 2 is used. In other words, at the engagers of the base plate 2 and the levers 3 and 4, the bearings 23 and the bearings 24 are formed by first forming pairs of parallel cut-and-raised portions, so that movements in the lengthwise directions of the rotary shafts of the levers 3 and 4, engaged at the locations where they are sandwiched at the bearings 23 and at the bearings 24, are restricted by the bearings 23 and bearings 24. The arms 5*a* and 5*b* of the third lever 5 are sandwiched at the slide bearings 25 (the cut-and-raised portions), so that movement of the third lever 5 in the directions of the rotary shafts is restricted. At the engagers of the holder 6 and the third lever 5, the arms 5*a* and 5*b* of the third lever 5 sandwich the bearings 6*d* and 6*d* of the holder 6, so that movement of the holder 6 in the direction of the rotary shafts of the lever 5 is restricted.

In this way, according to the keyswitch device 1 of the embodiment, there is no tilting of the keytop when the keytop is moved vertically during a key input operation. In addition, there is almost no rattling of the keytop, so that it is possible to prevent improper pressing of the keyswitch device, and, thus, to provide a keyswitch device having excellent operability.

Figure 6:
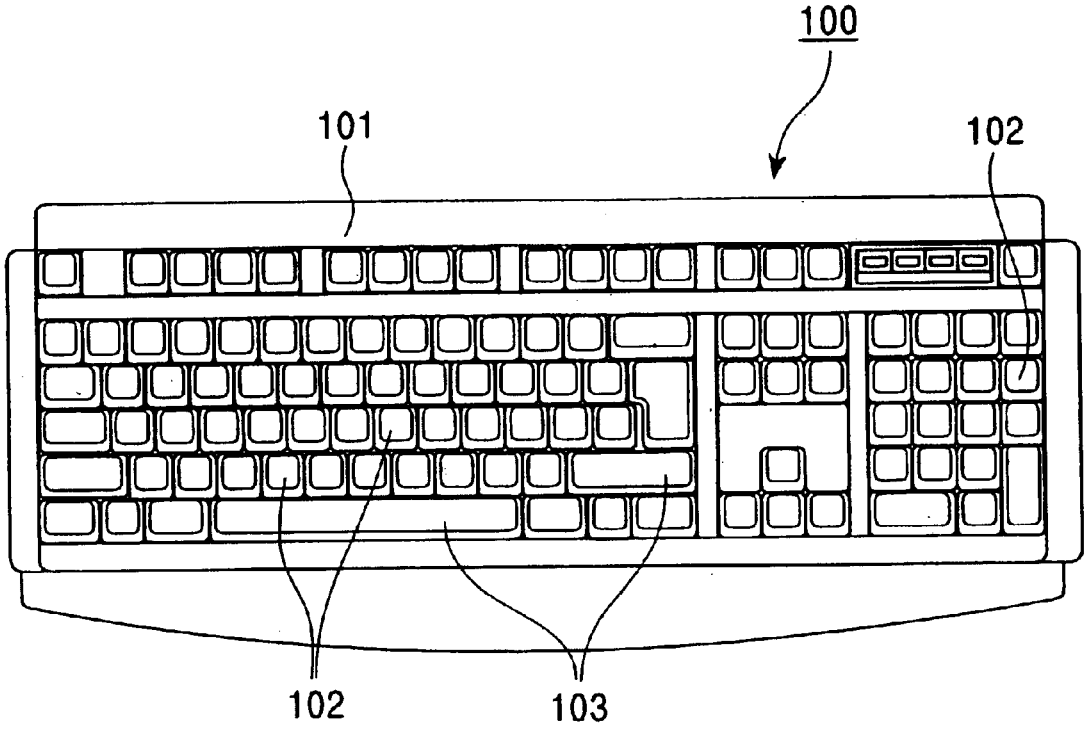
FIG. 6 is a plan view of an embodiment of a keyboard device comprising the keyswitch device of the present invention.

FIG. 6 is a perspective view of an embodiment of a keyboard device including the keyswitch device of the embodiment. A keyboard device 100 comprises a plurality of keyswitch devices 102 disposed on a frame 101. In the keyboard device 100 of the embodiment having such a structure, the keytops are held horizontally when the keytops are moved vertically. In addition, by including the keyswitch devices 102 in which there is almost no rattling of the keytops, a user will not improperly press a key during a key input operation, so that the key operation can be comfortably carried out. For large keyswitch devices 103, such as a space key, a plurality of the structural parts, excluding the key cap 10, of the keyswitch device 1 may be disposed below the key cap 10 that is long sideways.

As described above in detail, the keyswitch device of the present invention comprises a base; a plurality of levers, one side of each lever movably engaging the base; a keytop supported so as to be movable vertically with respect to the base by being engaged with the other side of each lever; and a switch for performing a switching operation when the keytop is moved vertically. In the keyswitch device, rotary shafts for allowing rotation of the respective levers within respective rotational planes are disposed at respective engagers at both sides of the levers. One of the engagers at each lever is a first engager for movably supporting one of the rotary shafts at the base or the keytop. The other engager at each lever is a second engager for rotatably supporting the other rotary shaft. The plurality of levers comprise a first lever, a second lever, and a third lever. The rotary shafts or rotary shaft lines of the first and second levers cross the rotary shafts of the third lever. The engagers at the keytop side at the first and second levers are the first engagers for rotatably and slidably engaging the rotary shafts of the first and second levers in a guide groove in the keytop. Therefore, the keyswitch device of the present invention can be easily reduced in size and thickness compared to the related keyswitch device having an X-shaped supporting structure. In addition, the operability of the keyswitch device during a key input operation is not impaired when it is reduced in size and thickness. Further, in the keyswitch device, rattling of the keytop in the horizontal direction is prevented from occurring. Still further, in the keyswitch device, when a peripheral edge of the top surface of the keytop is pressed, the keytop is not moved downward in a tilted state, so that it is moved downward while being kept substantially horizontal. Therefore, a user will not improperly press the keytop during a key input operation, and rattling of the keytop does not occur, so that the keyswitch device has excellent operability.

When the keyboard device of the present invention comprises the keyswitch device of the present invention, size reduction can be easily achieved. In addition, a user can comfortably perform a key input operation, so that the keyboard device excellent operability.

What is claimed is:

1. A keyswitch device comprising:

a base;

a plurality of levers, one side of each of the levers movably engaging the base;

a keytop supported so as to be movable vertically with respect to the base by being engaged with another side of each of the levers; and a switch that performs a switching operation when the keytop is moved vertically, wherein rotary shafts which allow rotation of the levers within respective rotational planes are disposed at respective engagers at both sides of the levers;

wherein one of the engagers at each of the levers is a first engager that movably supports one of the rotary shafts at one of the base and the keytop;

wherein another of the engagers at each of the levers is a second engager that rotatably supports another of the rotary shafts;

wherein the plurality of levers comprise a first lever, a second lever, and a third lever;

wherein one of the rotary shafts and rotary shaft lines of the first and second levers cross the rotary shafts of the third lever; and wherein the engagers at a keytop side at the first and second levers are the first engagers that movably engage the rotary shafts of the first and second levers in a guide groove in the keytop.

2. A keyswitch device according to claim 1, wherein each of levers comprise a pair of arms and at least one connecting section connecting the arms, and each of the levers has one of a U shape and a frame shape in plan view, and wherein the rotary shafts are disposed at respective sides of the arms.

3. A keyswitch device according to claim 2, wherein the first and second levers are each sandwiched at a pair of hook-shaped rotary bearings disposed at the base engaging the first and second levers, and wherein positions of the first and second levers in lengthwise directions of the rotary shafts of the first and second levers are restricted by the respective pairs of hook-shaped rotary bearings.

4. A keyswitch device according to claim 2, wherein the third lever is sandwiched at and engaged with a pair of hook-shaped slide bearings disposed at the base, and wherein a position of the third lever in a lengthwise direction of the rotary shaft is restricted by the hook-shaped slide bearings.

5. A keyswitch device according to claim 2, wherein the keytop and the third lever are engaged by engagement of a rotary bearing of the keytop and the shaft of the third lever, and wherein a position of the rotary bearing is restricted by being sandwiched by the pair of arms of the third lever.

6. A keyswitch device according to claim 1, wherein the rotary shaft at the keytop side of the third lever is disposed below the rotary shafts at the keytop side of the first and second levers.

7. A keyswitch device according to claim 1, wherein the keytop comprises a holder engaging each lever and a key cap adhered to the holder.

8. A keyswitch device according to claim 7, wherein the shafts at the keytop side of the first and second levers are sandwiched by a recessed portion of the holder, where the guide groove that movably supports the shafts is disposed, and the key cap adhered to the holder.

9. A keyboard device comprising the keyswitch device of claim 1.

* * * * *